US010330435B2

(12) United States Patent
McKendrick et al.

(10) Patent No.: US 10,330,435 B2
(45) Date of Patent: Jun. 25, 2019

(54) HOLSTER WITH SAFETY ACTIVATION

(71) Applicant: Safariland, LLC, Jacksonville, FL (US)

(72) Inventors: Matthew McKendrick, Jacksonville, FL (US); Dylan Vaccaro, Jacksonville, FL (US)

(73) Assignee: Safariland, LLC, Jacksonville, FL (US)

( * ) Notice: Subject to any disclaimer, the term of this patent is extended or adjusted under 35 U.S.C. 154(b) by 0 days.

(21) Appl. No.: 15/814,728

(22) Filed: Nov. 16, 2017

(65) Prior Publication Data

US 2018/0142987 A1 May 24, 2018

Related U.S. Application Data

(60) Provisional application No. 62/424,619, filed on Nov. 21, 2016.

(51) Int. Cl.
*F41C 33/02* (2006.01)

(52) U.S. Cl.
CPC ..... *F41C 33/0227* (2013.01); *F41C 33/0263* (2013.01)

(58) Field of Classification Search
CPC .. F41C 33/0227; F41C 33/0263; F41C 33/02; F41C 33/0218; F41C 33/0272; F41C 33/029
See application file for complete search history.

(56) References Cited

U.S. PATENT DOCUMENTS 2,088,811 A 8/1937 Ray
5,501,381 A 3/1996 Rogers et al.
6,769,581 B2 8/2004 Rogers et al.
7,543,404 B2 * 6/2009 Kovalchuk ..... F41C 33/0263 224/192
7,694,860 B2 4/2010 Clifton, Jr.
8,870,042 B2 * 10/2014 Clifton ..... A45F 5/02 224/198
9,759,515 B2 * 9/2017 Yeates ..... F41C 33/0227
2005/0024807 A1 * 2/2005 Cerovic ..... F41C 3/00 361/232
2005/0035163 A1 * 2/2005 French ..... F41C 33/0227 224/243

(Continued)

FOREIGN PATENT DOCUMENTS

JP 153770 A 8/2011

OTHER PUBLICATIONS

European Application No. 172021721—Extended European Search Report dated Mar. 21, 2018.

*Primary Examiner* — Corey N Skurdal

(74) *Attorney, Agent, or Firm* — Kane Kessler, P.C.; Paul E. Szabo

(57) ABSTRACT

A holster for a weapon that has a lovable actuator, such as a safety, has a movable holster part, such as a hood, that is supported on a body portion of the holster for movement relative to the body portion between an open position allowing the weapon to be removed from the body portion of the holster and a closed position blocking removal of the weapon from the body portion of the holster. The hood has an engagement portion that engages the safety of the weapon when the hood is moved from the open position to the closed position at a time when the weapon is in the holster.

9 Claims, 6 Drawing Sheets

(56) References Cited

U.S. PATENT DOCUMENTS

| | | | | |
|---|---|---|---|---|
| 2007/0181619 | A1* | 8/2007 | Seyfert | F41C 33/0227 224/196 |
| 2010/0170923 | A1* | 7/2010 | Abushaev | F41C 33/0263 224/243 |
| 2011/0266317 | A1 | 11/2011 | Clifton | |
| 2014/0048572 | A1* | 2/2014 | Yeates | F41C 33/0272 224/193 |

* cited by examiner

HOLSTER WITH SAFETY ACTIVATION

BACKGROUND OF THE INVENTION

A typical holster for a weapon such as a handgun or an electric discharge weapon includes a body portion defining a chamber having an opening. A muzzle portion of the weapon is inserted through the opening into the chamber. The weapon is thereby received and supported in the body portion of the holster.

Holsters with pivoting (rotating) hoods are known. The hood is supported on the body portion of the holster for pivotal movement relative to the body portion between (i) an open position uncovering the opening and thereby allowing the weapon to be inserted into the body portion, and (ii) a closed position extending across the opening arid thereby blocking removal of the weapon from the body portion. Closing the hood in this manner aids in retention of the weapon in the holster. One such type of hood is shown in U.S. Pat. No. 6,769,581, the disclosure of which is incorporated by reference.

Many weapons that can be holstered have a "safety", that is, a manually engageable member on the weapon that must be moved from an activated (or "on") position to a released (or "off") position, in order for the weapon to be fired. It is often desired that the safety be in the "safety on" position when the weapon is in the holster, to minimize chance of accidental discharge. Other holsterable weapons, such as an electrical discharge weapon ("EDW" one brand of which is Taser), might additionally or alternatively have a different type of "actuator", for example an electrical on/off switch, which desirably is in the "off" position when the weapon is holstered.

SUMMARY OF THE INVENTION

In accordance with the invention, a holster for a weapon that has a movable actuator includes a body portion with an opening for receiving the weapon. A movable holster part is supported on the body portion of the holster for movement relative to the body portion between an open position allowing the weapon to be removed from the body portion of the holster and a closed position blocking removal of the weapon from the body portion of the holster. The movable holster part has an engagement portion that engages the actuator of the weapon when the movable holster part is moved from the open position to the closed position at a time when the weapon is located in the body portion of the holster. In one embodiment, the movable holster part is a pivoting hood; the act of securing the weapon in the holster by closing the hood automatically ensures that the weapon's safety is on.

BRIEF DESCRIPTION OF THE DRAWINGS

Further features of the invention will become apparent to one of ordinary skill in the art to which the invention pertains from a reading of the following description of an embodiment of the invention together with the accompanying drawings, in which.

DESCRIPTION OF AN EMBODIMENT OF THE INVENTION

Figure 1:
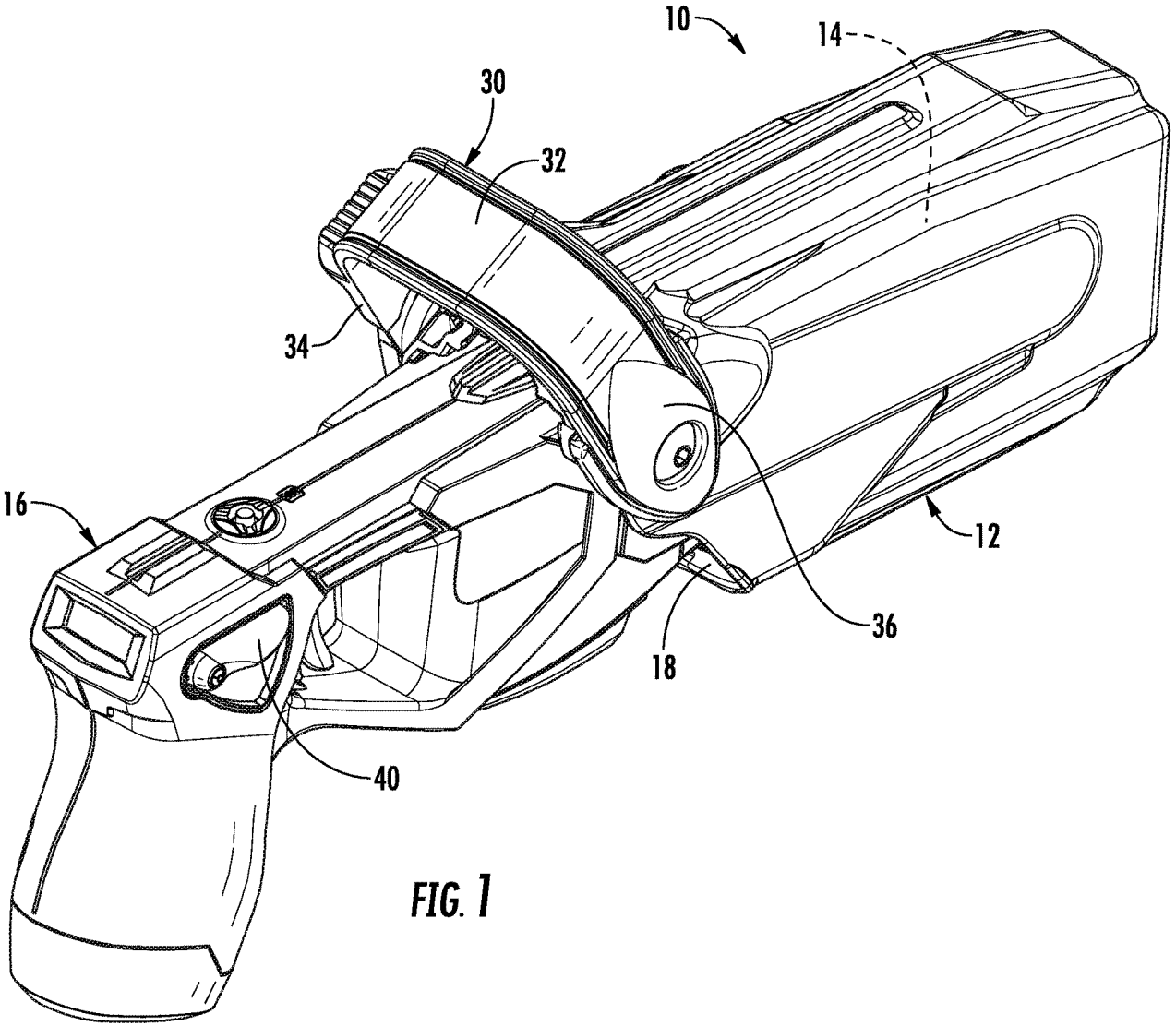
FIG. 1 is a perspective illustration from above of a weapon about to be inserted into a holster that is an embodiment of the present invention, showing the weapon's safety in the off position and the holster's hood in the open position.

The present invention relates to a holster. In particular, the present invention relates to a holster that includes structure for selectively moving an actuator of a weapon in the holster. The invention is applicable to holsters of varying and different constructions. As representative of the invention, FIG. 1 illustrates a holster 10 that is a first embodiment of the invention.

The holster 10 includes generally a body portion 12 and a hood 30. The body portion 12 of the holster 10 has a chamber 14 for receiving a weapon 16, and an opening 18 into the chamber. The weapon 16 may be inserted through the opening 18 so that a portion of the weapon including the muzzle is received in the chamber 14, thereby to support the weapon in the holster 10.

Typically, each holster 10 is configured to receive a particular brand or model of weapon 16. For example, a holster 10 can be configured to receive a particular model of a Glock pistol, or a particular model of a Taser brand EDW. The particular holster 10 that is shown in the drawings is configured to receive a Taser Model No. x26p weapon 16. The invention is applicable to many if not all such holsters.

The hood 30 is supported on the body portion 12 of the holster 10. The hood 30 is a part of the holster 10 that is movable to a position extending across the opening 18 into the chamber 14, to at least partially block removal of the weapon 16 from the holster 10. The hood 30 in the illustrated embodiment is a semi-rigid, generally U-shaped strap having a central portion 32 and two legs 34 and 36 that extend generally parallel to each other.

The outer ends of the legs 34 and 36 are connected with the holster body 12 to support the hood 30 for pivotal movement relative to the holster. The hood 30 is pivotable relative to the Holster body portion 12 between (i) an open position (FIGS. 1, 2, 3, 5, and 6) uncovering the opening 18 and thereby allowing the weapon 16 to be inserted into the body portion, and (ii) a closed position (FIGS. 4 and 4) extending across the opening 18. When the hood 30 is in the closed position, the central portion 32 of the hood 30 extends across the opening 18 to help block removal of the weapon 16 from the holster 10.

Figure 7:
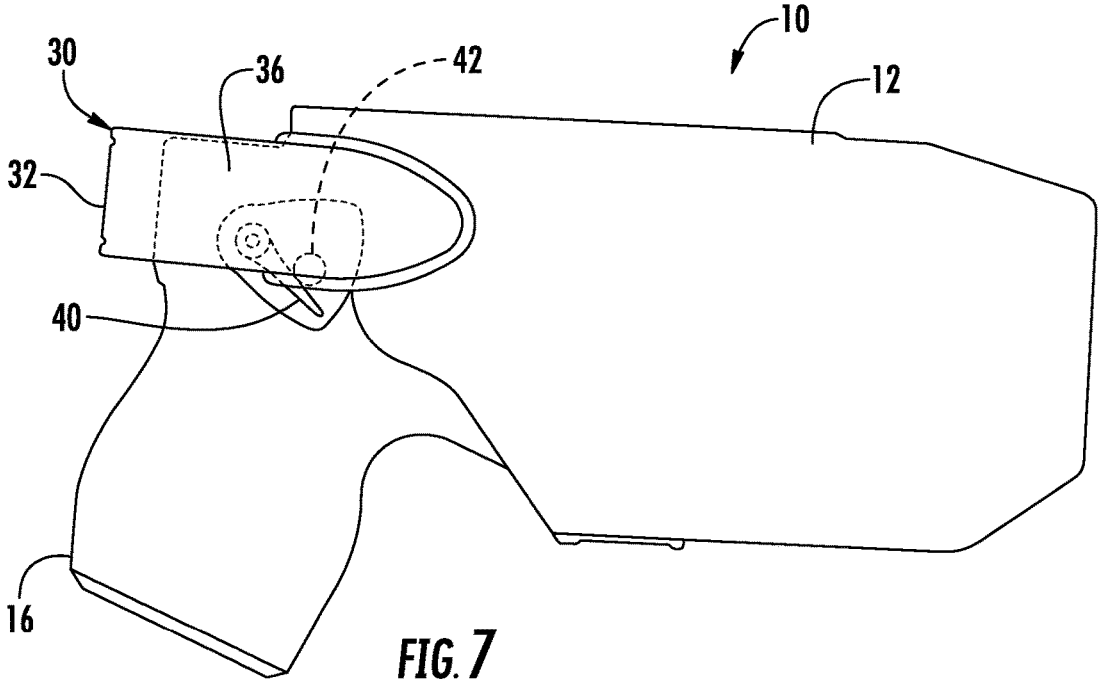

The weapon 16 has a safety 40. The term "safety" in this art is sometimes used to refer to the entire mechanism of the weapon 16 that blocks firing of the weapon, and is sometime used to refer to the actuatable physical part on the exterior of the weapon that controls said mechanism. In this case, the safety 40 is a pivotable lever that is movable between a first or "safety on" position (FIGS. 4 and 7) in which the safety is activated or engaged so that the weapon 16 cannot be fired, and a second or "safety off" position (FIGS. 1, 2, 3, 5, and 6) in which the safety is released or disengaged so that the weapon can be fired. A similar lever (not shown) is located on the opposite side of the weapon 16.

In accordance with the present invention, the holster 10 includes a feature that helps the user to ensure that the safety 40 is on (activated) when the weapon 16 is secured in the holster and the hood 30 is closed. Specifically, the hood 30 includes an engagement portion as described below that moves into engagement with the safety 40 when the hood is pivoted from the open position toward the closed position. When the hood 30 moves into the closed position, the engagement portion 42 of the hood pushes the safety 40 into the "safety on" position.

More specifically, the hood 30 includes an engagement portion in the form of a boss 42 that is located on the inside of one leg 36 of the hood 30. The boss 42 projects inward from the leg 36, in a direction toward the opposite leg 34 of the hood 30. The position of the boss 42 on the hood 30 is selected to cause the boss to pivotally move into and through the volume of space that is occupied by the safety lever 40 when the weapon 16 is in the holster 10. In the illustrated embodiment, the boss 42 is a separate element that is physically secured to the hood 30 for movement with the hood. Alternatively, the boss 42 could be formed as one piece with the hood 30.

Figure 2:
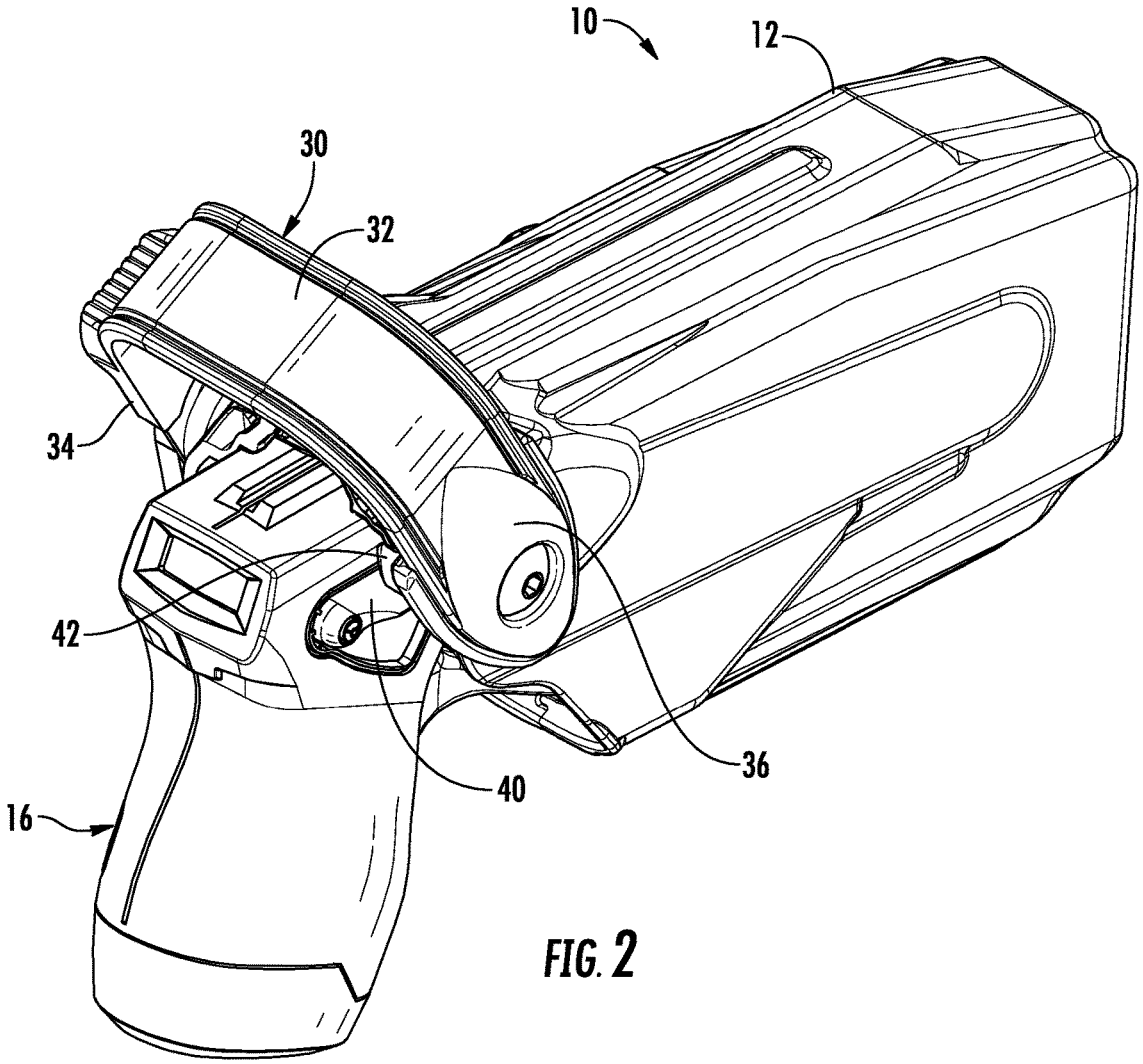
FIG. 2 is a perspective illustration similar to FIG. 1 showing the weapon inserted into the holster and the hood still in the open position.
Figure 3:
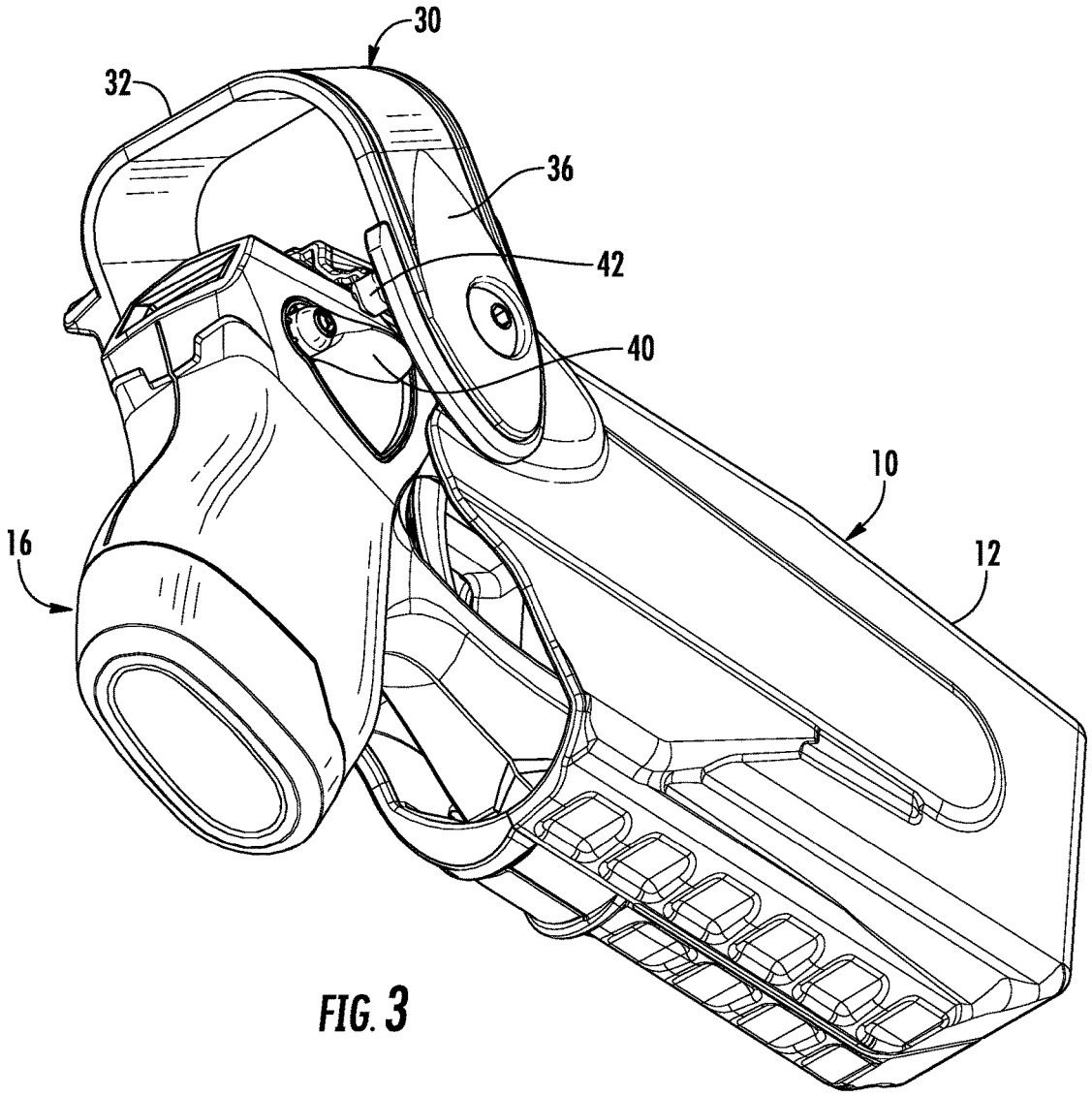
FIG. 3 is a perspective illustration from below showing the weapon inserted into the holster and the hood still in the open position.
Figure 5:
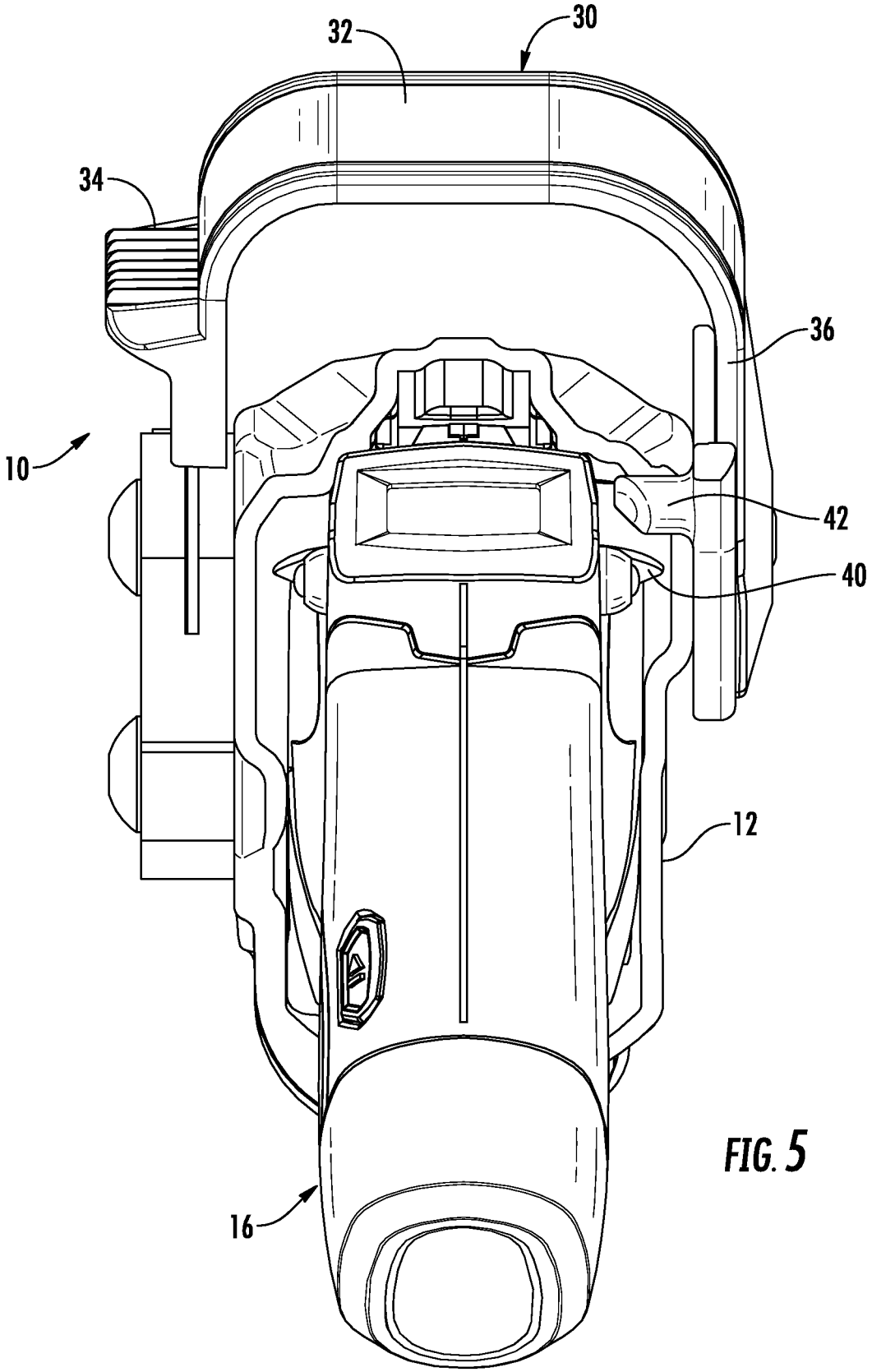
FIG. 5 is an end view from the direction of the weapon's muzzle showing the hood up.
Figure 6:
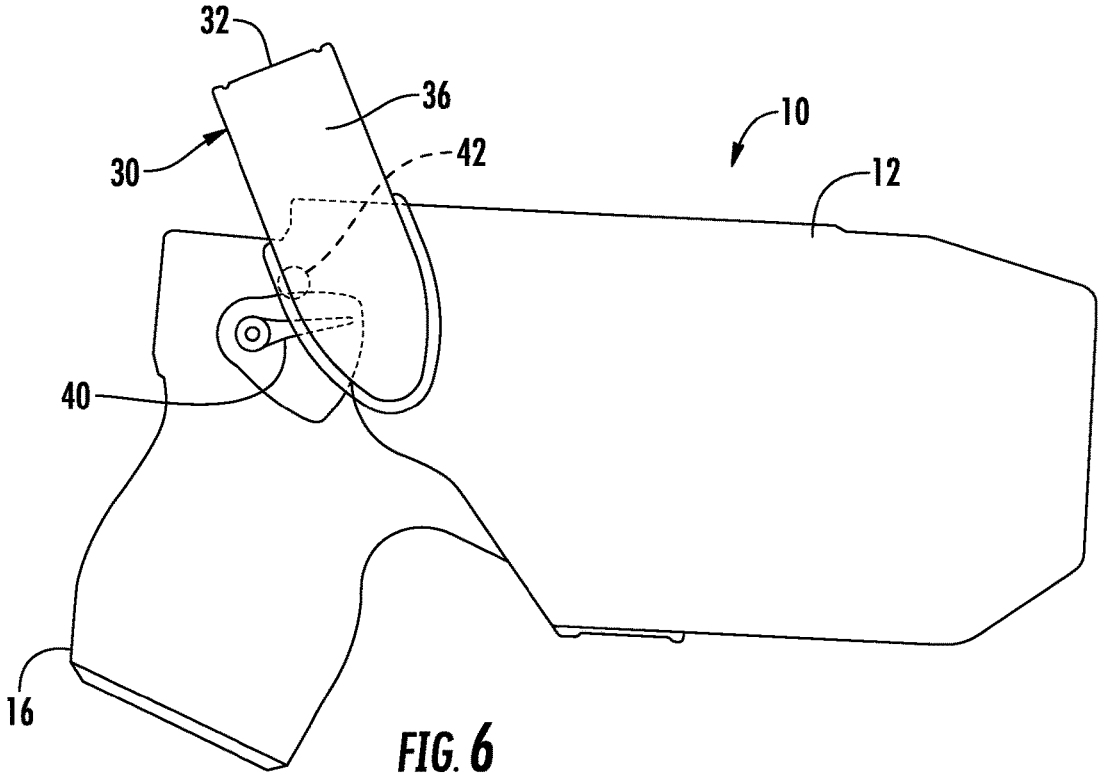
FIGS. 6 and 7 are schematic illustrations of the operation of the holster hood in moving the weapon's safety to the on position.

This operation can be seen in a comparison of the several Figures of the drawings. In FIG. 1, the hood 30 is in the open position, and the weapon 16 is in the process of being inserted into the chamber 14 in the holster, through the opening 18. The weapon's safety 40 is in the "safety off" position. In FIGS. 2, 3 and 5, the weapon 16 has been inserted into the chamber 14 of the holster, and the hood 30 is still in the open position, that is, not extending across the opening 18. The weapon's safety 40 remains in the "safety off" position.

Figure 4:
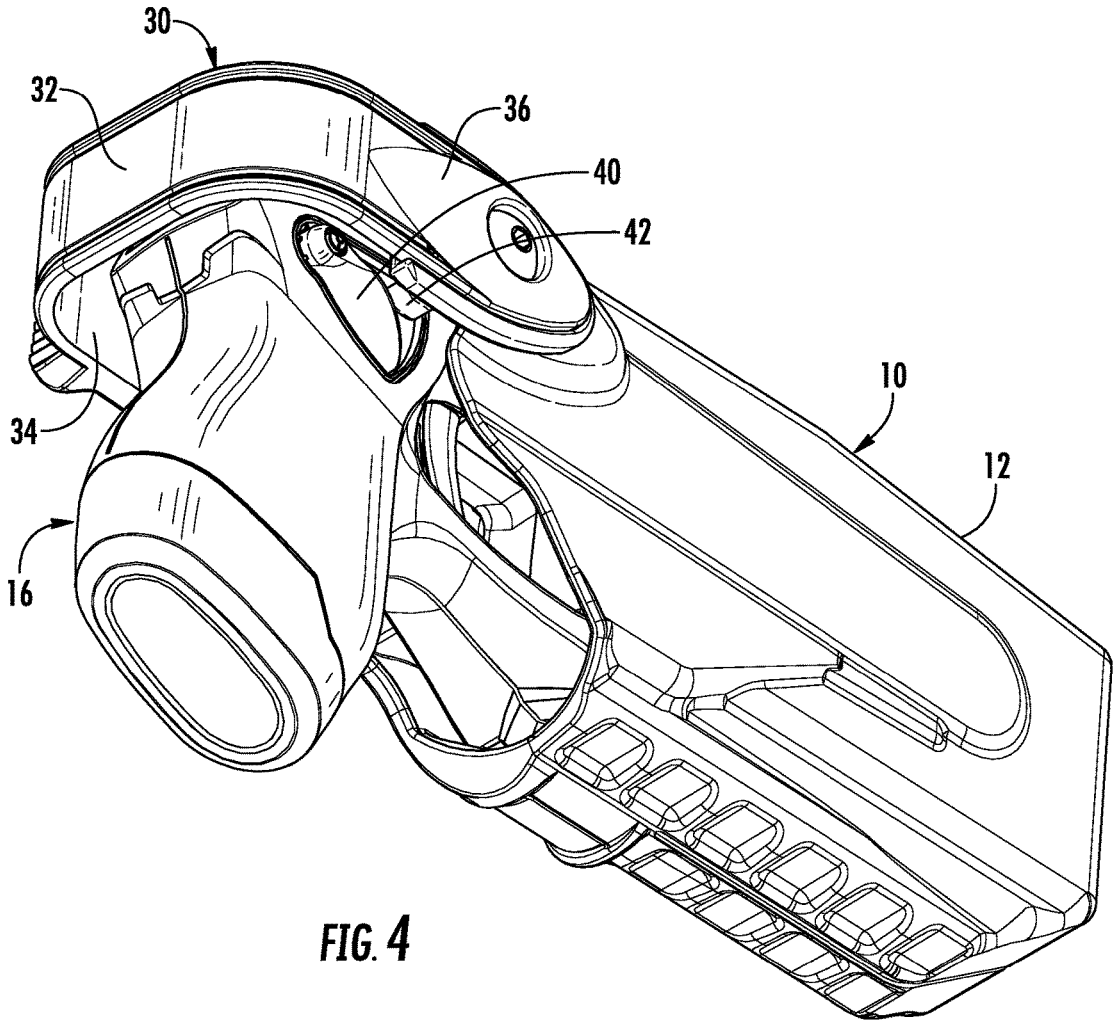
FIG. 4 is a perspective illustration from below showing the weapon inserted into the holster, with the hood in the closed position having moved the weapon's safety to the on or actuated position.

In FIG. 4, the weapon 16 is in the chamber 14 of the holster, and the hood 30 has been pivoted from the open position to the closed position. During this pivoting movement, the boss 42 on the hood 30 has engaged the safety 40 and has moved it to the "safety on" position. As a result, not only is the hood 30 in the closed position extending across the holster opening 18 and blocking removal of the weapon 16 from the holster, but also the weapon's safety 40 has been actuated. This operation is also illustrated schematically in a comparison of FIGS. 6 and 7.

Another benefit of the present invention accrues to some electrically powered weapons, particularly electronic discharge weapons. In these weapons, moving the safety to the "safety on" position also ensures that the electrically powered elements of the weapon are off; thus, the battery is not drained. Furthermore, the invention is usable in holsters that have a safety device (distinct from the hood) for securing the weapon in place in the holster to inhibit unauthorized or accidental withdrawal of a handgun from a holster. A wide variety of such safety devices exist to inhibit withdrawal of a handgun from a holster by anyone other than the user. One such safety device is disclosed in Applicant's U.S. Pat. No. 7,694,860, the entire disclosure of which is incorporated herein by reference. The safety device shown in said patent is compatible with the pivoting hood of the embodiment illustrated herein.

The present invention is not limited to the particular physical embodiment that is shown and described. Thus, the invention can he embodied in holsters for weapons that have other types of safeties, such as safeties that slide rather than pivot, or safeties that are moved inward in addition to laterally. The invention can also be embodied in holsters for weapons that have other types of movable members, for example, an on/off switch. Any such movable member can be considered to be an "actuator" whose position is changed by the movement of the hood as described herein. Further, the invention is not limited to the use of a "hood" as shown, and can include the use of other movable parts.

The invention claimed is:

1. A holster for a weapon that has an actuator movable between first and second positions to control operation of the weapon, the actuator being located on a portion of the weapon that is exposed when the weapon is in the holster, the holster including:

a body portion with an opening for receiving a first portion of the weapon including a muzzle of the weapon, the holster body portion being configured to leave exposed a second portion of the weapon including a grip of the weapon and the actuator when the weapon is in the holster;

a hood supported on the body portion of the holster for movement relative to the body portion between an open position allowing the first portion of the weapon to be removed from the body portion of the holster and a closed position blocking removal of the first portion of the weapon from the body portion of the holster;

the hood having an engagement portion for engagement with the actuator of the weapon to move the actuator between the first and second positions when the hood is moved from the open position to the closed position at a time when the first portion of the weapon is located in the body portion of the holster.

2. A holster as set forth in claim 1 wherein the hood is generally U-shaped and has a central portion that extends across the opening in the holster body portion when the movable holster part is in the closed position.

3. A holster as set forth in claim 2 wherein the hood moves pivotally between the open position and the closed position.

4. A holster as set forth in claim 3 wherein the engagement portion is a projecting element on the inside of a leg portion of the hood, that moves through the volume of space occupied by the actuator when the weapon is in the holster.

5. A holster as set forth in claim 1 wherein the actuator is a safety of the weapon.

6. A holster as set forth in claim 1 wherein the actuator is an electrical switch of the weapon.

7. In combination:

a holster: and a weapon in the holster, the weapon having an actuator;

the holster including a body portion that receives the weapon; and the holster including a hood supported on the body portion for pivotal movement relative to the body portion between an open position allowing the weapon to be inserted into the body portion and a dosed position blocking removal of the weapon from the body portion;

the hood having an engagement portion that engages and moves the actuator of the weapon when the hood is pivoted from the open position to the closed position while the weapon is located in the body portion of the holster.

8. A combination as set forth in claim 7 wherein the actuator is a safety of the weapon.

9. A combination as set forth in claim 7 wherein the actuators is an electrical switch of the weapon.

* * * * *